US006042483A

United States Patent [19]

Katayama

[11] Patent Number: 6,042,483

[45] Date of Patent: Mar. 28, 2000

[54] METHOD OF MEASURING MOTION OF A GOLF BALL

[75] Inventor: Shu Katayama, Saitama, Japan

[73] Assignee: Bridgestone Sports Co., Ltd., Tokyo, Japan

[21] Appl. No.: 08/960,260

[22] Filed: Oct. 29, 1997

[30] Foreign Application Priority Data

Oct. 30, 1996 [JP] Japan ..... 8-304102
Aug. 4, 1997 [JP] Japan ..... 9-208793

[51] Int. Cl.[7] ..... G06F 51/00; A63B 69/36

[52] U.S. Cl. ..... 473/199; 473/152

[58] Field of Search ..... 473/150, 151, 473/152, 153, 154, 155, 156, 198, 199

[56] References Cited

U.S. PATENT DOCUMENTS

| | | | |
|---|---|---|---|
| 4,375,887 | 3/1983 | Lynch et al. | 473/199 |
| 4,713,686 | 12/1987 | Ozaki et al. | 434/369 |
| 5,054,785 | 10/1991 | Gobush et al. | 473/199 |
| 5,342,054 | 8/1994 | Chang et al. | 473/156 |
| 5,413,345 | 5/1995 | Nauck | 473/156 |
| 5,471,383 | 11/1995 | Gobush et al. | 473/199 |
| 5,489,099 | 2/1996 | Rankin et al. | 473/199 |
| 5,501,463 | 3/1996 | Gobush et al. | 473/199 |
| 5,575,719 | 11/1996 | Gobush et al. | 473/199 |
| 5,768,151 | 6/1998 | Lowy et al. | 473/317.1 |
| 5,803,823 | 9/1998 | Gobush et al. | 473/199 |
| 5,906,547 | 5/1999 | Tynan | 473/199 |
| 5,926,780 | 6/1999 | Fox et al. | 473/140 |

*Primary Examiner*—Jessica J. Harrison
*Attorney, Agent, or Firm*—Sughrue, Mion, Zinn, Macpeak & Seas, PLLC

[57] ABSTRACT

There is disclosed a method of measuring the motion of a golf ball. The passing of a club head to hit a ball is detected by a sensor. A detection signal is sent from the sensor to a trigger section of a control unit. In response to the detection signal, shutter signals are sent from the trigger section to first and second cameras at a proper timing, while providing an appropriate time lag between the shutter signals, so as to photograph an image of the hit golf ball through the first and second cameras. The first and second cameras are disposed facing horizontally, apart from each other, and away from the set position of the ball at a predetermined distance. This method enables the motion of the golf ball to be measured even outdoors and through use of a relatively inexpensive apparatus.

8 Claims, 3 Drawing Sheets

METHOD OF MEASURING MOTION OF A GOLF BALL

BACKGROUND OF THE INVENTION

1. Field of the Invention

The present invention relates to a method of measuring the motion of a golf ball that moves at an ultrahigh speed in which the golf ball is photographed in order to analyze the motion of the golf ball.

2. Description of the Related Art

Conventionally, DINAFAX (trade name) is available on the market as an apparatus for photographing a golf ball in a state in which the golf ball moves at an ultrahigh speed, such as an impact state in which the golf ball receives an impact from a swinging golf club. The DINAFAX has a rotatable cylindrical unit, and film is disposed on the inner circumferential surface of the cylindrical unit. A lens is provided at a position located away from the center of the cylindrical unit along the axial direction thereof. An image obtained through the lens is projected onto the film through a prism. For high speed photography, the cylindrical unit rotates to thereby sequentially photograph images on the film. Also, Japanese Patent Application Laid-Open (kokai) No. 62-104279 discloses a method which uses a high-speed instantaneous multi-image recording apparatus in combination with a video camera and a strobe.

However, the former method involves the process of developing a film and a problem that when the motion of an object to be photographed continuously varies at an ultrahigh speed, whether or not the object has been successfully photographed is unknown until development is completed. Accordingly, re-photographing is often required, in turn requiring much labor and time for experimentation. According to the latter method, the strobe flashes repeatedly to photograph a number of images of a dynamic object within one display area (multi-image photography) while the shutter of the video camera is open. Thus, this method can be carried out only in a dark place (in a place having at most the brightness of a room). Also, the apparatus itself is very expensive.

SUMMARY OF THE INVENTION

The present invention has been accomplished in view of the above problems, and an object of the present invention is to provide a method of measuring the motion of a golf ball capable of being carried out even outdoors and through use of a relatively inexpensive apparatus.

To achieve the above object, the present invention provides a method of measuring the motion of a golf ball, comprising the steps of: detecting by sensor means the passing of a club head to hit a ball set at a predetermined position; sending a detection signal from the sensor means to trigger means of a control unit; and in response to the detection signal, sending shutter signals from the trigger means to respective first and second cameras at a proper timing, while providing an appropriate time lag between the shutter signals, so as to photograph the hit golf ball through the first and second cameras, the first and second cameras facing horizontally, apart from each other, and away from the set position of the ball at a predetermined distance.

According to the present invention, in order to calculate the carry of a hit ball and to simulate the trajectory of a hit ball, only the velocity of the hit ball, the angle of hit, and the amount of backspin are measured as initial conditions by means of the horizontally facing first and second cameras.

Thus, a system for measuring the motion of a golf ball can be realized in a relatively simple configuration and at low cost. Also, since the initial conditions of a ball can be easily measured, the development of golf balls and the evaluation of performance of golf balls is highly facilitated. For example, a certain kind of ball may be tested through use of different kinds of golf clubs to thereby evaluate the performance of the golf clubs.

DESCRIPTION OF THE PREFERRED EMBODIMENT

Figure 1:
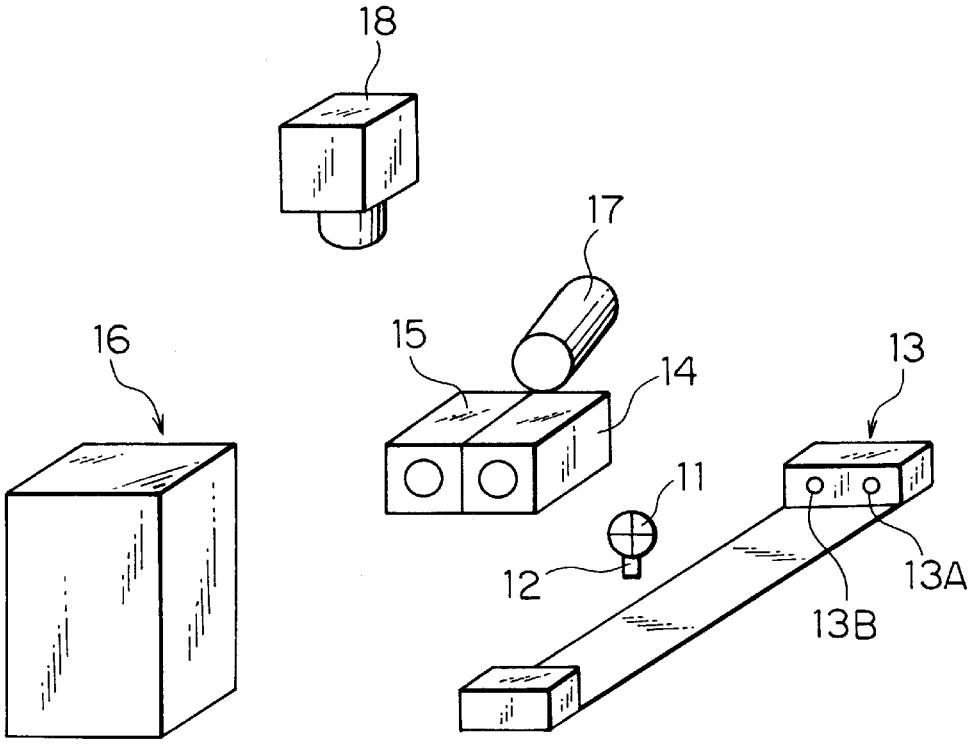
FIG. 1 is a schematic view showing an apparatus which employs a method according to the present invention.

An embodiment of the present invention will now be described with reference to the drawings. FIG. 1 shows an example of an apparatus embodying a method of the present invention. The apparatus includes golf ball setting means 12 for setting a golf ball 11 in place, specifically a tee for placing the golf ball 11 thereon, (hereinafter referred to as tee 12), sensor means 13 for detecting the passing (down swing) of a club head (not shown) for hitting the ball 11, a first camera 14 and a second camera 15, and a control unit 16. The sensor means 13 is located behind the tee 12 in the travel direction of the ball 11. The first camera 14 and the second camera 15 are disposed ahead of the tee 12 in the travel direction of the ball 11 such that they are located at a predetermined distance from the tee 12 and that they are apart from each other and face horizontally. The control unit 16 has trigger means for sending shutter signals to the respective first and second cameras 14 and 15. When a detection signal is received from the sensor means 13, the trigger means sends shutter signals to the first and second cameras 14 and 15 at a proper timing such that an appropriate time lag is provided between the shutter signals sent to the first and second cameras 14 and 15. The first and second cameras 14 and 15 are preferably CCD cameras having a shutter speed of $1/10{,}000$ to $1/200{,}000$ second.

The sensor means 13 includes a first optical sensor 13A and a second optical sensor 13B, each composed of a light emitting element and a light receiving element. The distance m1 between the first optical sensor 13A and the second optical sensor 13B is preferably approximately 70 mm. The distance m2 between the tee 12 and the second optical sensor 13B is preferably approximately 40 mm. The distance m3 between the tee 12 and the first camera 14 and the distance m4 between the first and second cameras 14 and 15 preferably range from 50 to 300 mm and from 100 to 250 mm, respectively. The positional height of the first and second cameras 14 and 15 with respect to the golf ball 11 (placed on the tee 12) must be determined in consideration of the trajectory of the hit ball 11. For a certain place of measurement, a light 17 may be provided for illuminating the trajectory of the hit ball 11, or a downwardly facing camera 18, which will be described later, may be provided in addition to the first and second cameras 14 and 15. Also, these cameras 14, 15, and 18 may be equipped with respective strobes 19 (flashing means) which operate synchronously with shutters thereof. The horizontal distance between the hit ball 11 on its trajectory and each of the first and second cameras 14 and 15 is preferably 200 to 600 mm.

In the present embodiment, the downwardly facing camera 18 similar to the first and second cameras 14 and 15 is provided in order to photograph the hit golf ball 11 from a position substantially above the trajectory thereof. The "position substantially above the trajectory" means a "position right above the trajectory" or a "position above the trajectory but slightly offset sidewise therefrom." The horizontal position of the camera 18 from the tee 12 is preferably near the first camera 14 (distance m3 from the tee 12), since the tee 12 must be displayed together with the ball 11 within the same display area on the screen. When the camera 18 is located directly above the trajectory of the hit ball 11, the height of the camera 18 is preferably approximately 3 m thereabove; when the camera 18 is located obliquely above the trajectory, the height of the camera 18 is preferably 1.5 m to 2 m thereabove. Thus, the view of the camera 18 is not obstructed by the first camera 14 or the second camera 15.

The control unit 16, connected to the sensor means 13 and the cameras 14, 15, and 18 equipped with the respective strobes 19 (specific connections are not illustrated), includes the following:

(1) Control Box

The control box includes the following:

a) Frame memory for recording photographed images b) Image analysis unit c) Timing control unit Sensor control, shutter control, I/O d) CPU unit e) FDD (floppy disk drive) and HDD (hard disk drive) or flash memory (2) Software Software for performing the following functions:

a) Calculation and display of head speed, speed of a hit ball, backspin, side spin, and launch angle (upward angle with a horizontal line and sideward angle with a reference line)

b) Calculation of trajectory and travel distance c) Display of following screens quartered screen (3 display areas for displaying the image of a ball and 1 display area for displaying measured values)

Launch angle distribution screen

Carry and/or total distance distribution screen

Trajectory screen d) Accumulation of data (3) Monitor and Printer

Figure 2:
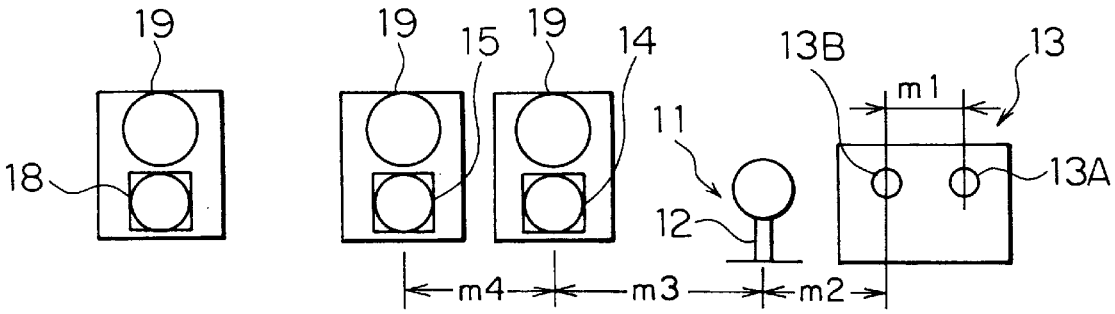
FIG. 2 is a view showing the arrangement of devices of the apparatus.
Figure 3:
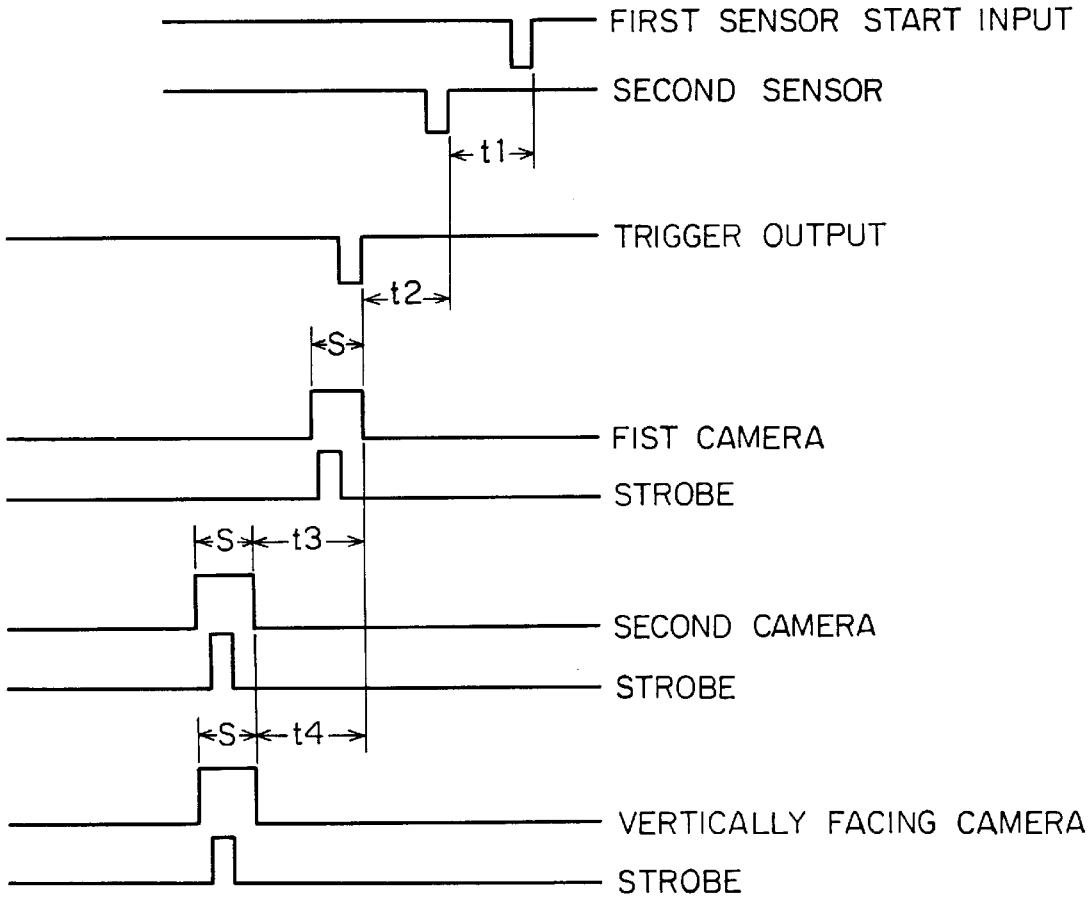
FIG. 3 is a timing chart illustrating operations of the devices.

Next, this method will be described with reference to FIGS. 2 and 3. When the first and second sensors 13A and 13B detect the pass of a golf club head, the control unit 16 calculates time t1 required for the club head to pass between the sensors. Based on the measured time t1 and the distance between the sensors 13A and 13B, the control unit 16 calculates a head speed. Upon reception of a detection signal from the second sensor 13B, the control unit 16 outputs a trigger signal to each of the cameras 14, 15, and 18 and to each of the strobes 19. In the present embodiment, a plurality of head speeds are previously measured. In operation, a delay time t2 and shutter intervals t3 and t4 (see FIG. 3) are previously set in accordance with an applicable head speed selected from the previously measured head speeds. When the delay time t2 has elapsed after the reception of the detection signal, the first camera 14 is operated. When the shutter intervals t3 and t4 have elapsed, respectively, after the operation of the first camera 14, the second camera 15 and the downwardly facing camera 18 are operated, respectively.

Figure 4:
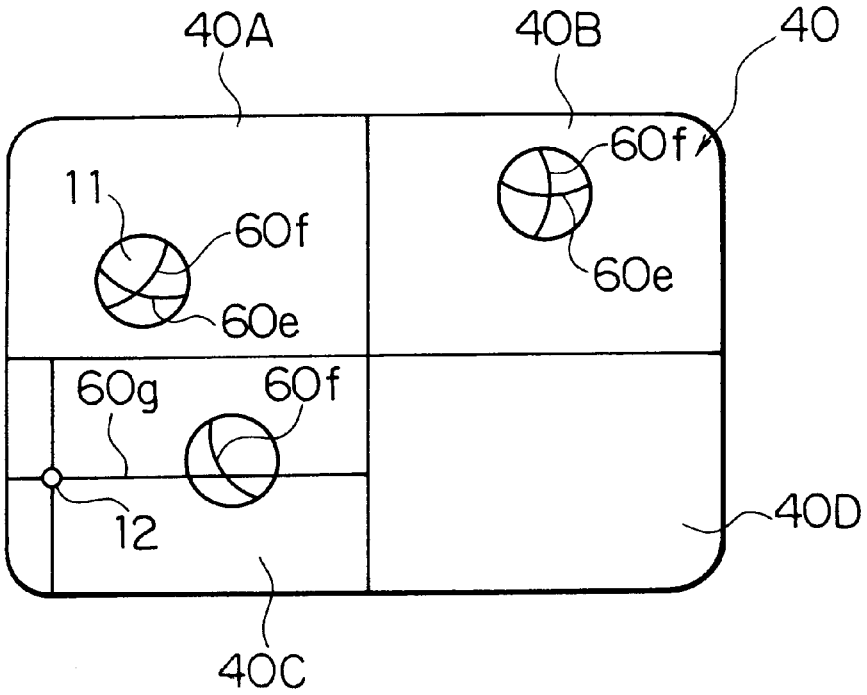
FIG. 4 is a view showing a monitor screen.

FIG. 4 shows the monitor screen of the control unit 16 on which images of the hit ball 11 are displayed. The monitor screen 40 is divided into four display areas. A first display area 40A displays the side view of the hit ball 11 as obtained through the first camera 14. A second display area 40B displays the side view of the hit ball 11 as obtained through the second camera 15. A third display area 40C displays the top view of the hit ball 11 as obtained through the downwardly facing camera 18. A fourth display area 40D displays measured values.

Figure 5:
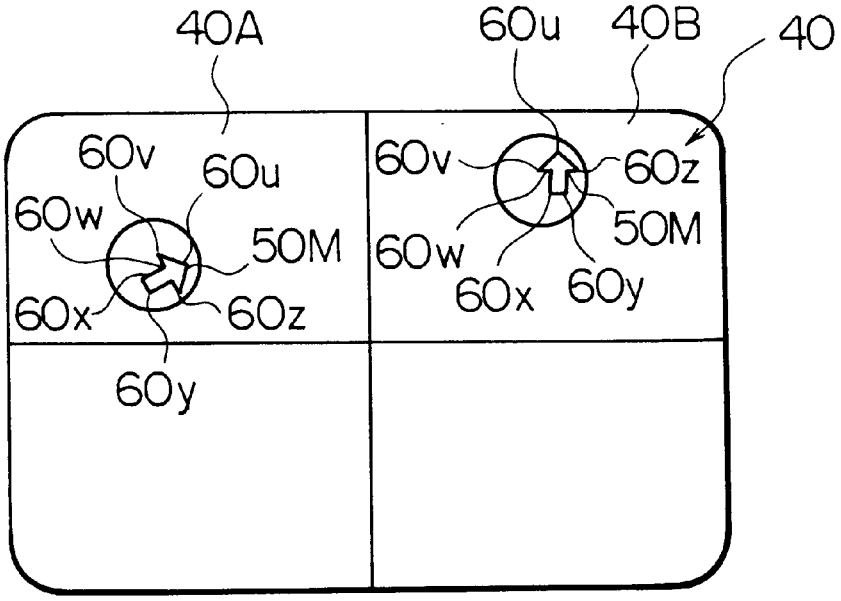
FIG. 5 is a view showing a monitor screen.

Reference numeral 60*e* denotes a line marked on the golf ball 11 along the equator thereof, and numeral 60*f* denotes a line marked on the ball 11 perpendicularly to the line 60*f*. For example, a change in the angle of the line 60*e* between the first display area 40A and the second display area 40B is measured. Then, based on the thus-measured change of the angle and the time t3 (FIG. 3), the amount of backspin (angular velocity) is obtained. Further, through the measurement of the movement of a certain point on the spherical surface of the ball 11 (this movement appears in the form of a difference in appearance between the first and second display areas 40A and 40B), the amount of side spin can be obtained likewise. Alternatively, as shown in FIG. 5, the ball 11 is marked with a black arrow 50M. The three-dimensional vector of at least one of (or the three-dimensional vector of each of) six angular points 60*u*, 60*v*, 60*w*, 60*x*, 60*y*, and 60*z* is obtained based on images appearing in the first and second display areas 40A and 40B with the ball 11 taken as a unit ball having a radius of 1. Based on the movement of the ball 11 from its position in the first display area 40A to that in the second display area 40B, the vector of the rotational axis of the ball 11 is obtained. Through vector analysis based on the thus-obtained three-dimensional vector(s) of the point(s) and the thus-obtained vector of the rotational axis, the amount of rotation of the ball 11 is obtained. Based on the vector of the rotational axis and the thus-obtained amount of rotation, the amounts of backspin and side spin of the ball 11 can be obtained.

Also, a difference in vertical position of the golf ball 11 between the first display area 40A and the second display area 40B (FIGS. 4 and 5) is measured. Then, based on the thus-measured difference in vertical position and the distance m4 (horizontal distance), the upward launch angle of the ball 11 can be obtained. Further, in the third display area 40C shown in FIG. 4, the distance between a reference line 60*g* (whose angle of sideward deviation is 0) drawn through the tee 12 and the center of the ball 11 and the distance between the tee 12 and the center of the ball 11 are measured. Then, based on the thus-measured distances and the distance m3 (FIG. 2), the sideward launch angle of the ball 11 can be calculated. This calculation is based on the assumption that the downwardly facing camera 18 is set at the same position as that of the first camera 14 with respect to the position of the tee 12.

The sideward launch angle of the golf ball 11 can also be calculated based on a difference in a ball diameter between an image of the golf ball 11 in the first display area 40A and that in the second display area 40B. In this case, the following data are registered in the frame memory of the control box for recording images photographed by cameras: the size (as displayed on the screen) of the ball 11 positioned on the reference line 60*g* for both of the first and second cameras 14 and 15; the size (as displayed on the screen) of the ball 11 located, for example, 100 mm away from the line

60*g* on the same side as the cameras 14 and 15; and the size (as displayed on the screen) of the ball 11 located, for example, 100 mm away from the line 60*g* on the opposite side to the cameras 14 and 15. In this case, the ball 11 located closer to the cameras 14 and 15 is displayed larger on the screen. Subsequently, the ball 11 is hit by a golf club, and the images of the hit ball 11 photographed by the first and second cameras 14 and 15 are compared with the registered images, to thereby calculate the sideward launch angle of the ball 11 based on a difference in a ball diameter between the image of the golf ball 11 in the first display area 40A and that in the second display area 40B. This method does not require the downwardly facing camera 18.

Through use of CCD cameras having a shutter speed of $1/10{,}000$ to $1/200{,}000$ as the cameras 14, 15, and 18 in combination with respective strobes which operate synchronously with the cameras, an image of a white golf ball will be displayed in the black background regardless of whether the method of the present invention is carried out indoors or outdoors. Also, a character or a mark indicated on a ball is also clearly displayed in black. As mentioned previously, the movement of a certain point(s) on a character or mark appearing on a golf ball image is automatically obtained on a computer through use of an image-analyzing technique such as a digitization technique to thereby calculate the amount of spin of a golf ball. Likewise, through use of the computer analysis, the above-mentioned diameters of displayed golf balls can be obtained. Based on the thus-obtained diameters, the sideward launch angle of a golf ball can be calculated. Accordingly, the motion of a golf ball can be efficiently and accurately analyzed.

What is claimed is:

1. A method of measuring the motion of a golf ball, comprising the steps of detecting by sensor means the passing of a club head to hit a ball set at a predetermined position, wherein the ball has a mark displayed on the outer surface thereof;

sending a detection signal from the sensor means to trigger means of a control unit; and in response to the detection signal, sending shutter signals from the trigger means to respective first and second CCD cameras having a shutter speed of $1/10{,}000$ to $1/200{,}000$ second at a proper timing, while providing an appropriate time lag between the shutter signals, photographing an image of the hit golf ball through the first and second CCD cameras, wherein the first and second CCD cameras located facing horizontally, apart from each other, and away from the set position of the ball at a predetermined distance, comparing the marks of images of the hit ball with each other which are photographed by the first and second CCD cameras and;

determining a motion of at least one certain point of the mark to obtain the motion of the golf ball hit.

2. A method according to claim 1, wherein the speed of the hit ball is calculated based on a distance and a shutter interval between the first and second CCD cameras through use of a calculation section of the control unit.

3. A method according to claim 1, wherein images of the hit ball photographed by the first and second CCD cameras are compared with each other, and a launch angle of the ball with a horizontal line is calculated through use of image-analyzing means of the control unit.

4. A method according to claim 1, wherein the sensor means is set at each of two different positions where the club head to hit the ball passes, and a calculation section of the control unit is caused to calculate the speed of the club head based on a time difference between detection signals issued from the two sensor means.

5. A method according to claim 1, wherein based on the motion of the certain point of the mark, a three-dimensional vector is obtained and through vector analysis based on the three-dimensional vector, the vector of rotational axis and an amount of rotation of the ball are obtained.

6. A method according to claim 5, wherein based on the vector of the rotational axis and the amount of the rotation, an amount of back spin is obtained.

7. A method according to claim 5, wherein based on the vector of the rotational axis and the amount of the rotation, an amount of side spin is obtained.

8. A method according to claim 5, wherein the ball is marked with a black colored arrow having a plurality of angular points and the motion of at least one of the angular points is determined so as to obtain the three-dimensional vector.

* * * * *